US011344794B2

(12) United States Patent
Tatonetti

(10) Patent No.: US 11,344,794 B2
(45) Date of Patent: May 31, 2022

(54) DEEP CUTOUT SAFE PUZZLE

(71) Applicant: Thomas Tatonetti, Brooklyn, NY (US)

(72) Inventor: Thomas Tatonetti, Brooklyn, NY (US)

( * ) Notice: Subject to any disclaimer, the term of this patent is extended or adjusted under 35 U.S.C. 154(b) by 0 days.

(21) Appl. No.: 17/247,002

(22) Filed: Nov. 23, 2020

(65) Prior Publication Data

US 2021/0077899 A1 Mar. 18, 2021

(51) Int. Cl.
*A63F 9/06* (2006.01)
*A63F 9/10* (2006.01)

(52) U.S. Cl.
CPC ..... *A63F 9/10* (2013.01); *A63F 9/0666* (2013.01)

(58) Field of Classification Search
CPC ..... A63B 9/10; A63F 9/0666; A63F 9/0098
USPC ..... D21/470; 446/118; 434/188–216
See application file for complete search history.

(56) References Cited

U.S. PATENT DOCUMENTS 505,027 A * 9/1893 Carpenter ..... A63F 7/04 273/117
2,014,675 A * 9/1935 Beulah ..... G09B 19/02 434/204
2,542,948 A * 2/1951 Scherf ..... A63F 9/10 434/259
2,659,163 A * 11/1953 Wilder ..... A63F 9/0666 273/273
3,381,394 A * 5/1968 Munro ..... G09B 19/02 434/193
3,479,751 A * 11/1969 Welbourn ..... A63F 9/10 434/259
D218,242 S * 8/1970 Gompes ..... D21/479
3,819,184 A * 6/1974 McPhail ..... A63F 3/00094 273/264
3,918,178 A * 11/1975 Riley ..... G09B 1/36 434/193
4,306,868 A * 12/1981 Hankins ..... A63F 3/0423 434/159
4,487,585 A * 12/1984 Goldwasser ..... A63F 9/10 273/156

(Continued)

FOREIGN PATENT DOCUMENTS

DE 2826123 A1 * 12/1979 ..... A63F 9/0666
FR 364721 A * 8/1906 ..... A63F 9/10

OTHER PUBLICATIONS

"Classic World: Geometric Blocks", <https://www.classicntoys.com/product/geometric-blocks/>, retrieved on Aug. 18, 2021. (Year : 2021).*

(Continued)

*Primary Examiner* — Steven B Wong

(57) ABSTRACT

A safe puzzle is configured with deep cutouts inside a base block, and inside the cutouts are respective pegs that are shielded by the surrounding walls. The base block may have multiple cutouts and inside each one is a peg that serves as the puzzle for the child. The cutouts can have a square peg, triangular peg, circular peg, and ovular peg that extends in a vertical direction from a floor of each cutout. A gap between the peg and the cutout's walls surrounds the pegs so that the child and a parent have sufficient space for their hand to manipulate the blocks, such as place the blocks over the pegs and remove the blocks from the pegs. The pegs have a height that is equal to or below the base block's top surface to create a safer environment for toddlers when playing with the puzzle.

6 Claims, 7 Drawing Sheets

(56) References Cited

U.S. PATENT DOCUMENTS 4,609,356 A * 9/1986 Gilden ..... A63F 9/0666 434/259
4,822,051 A * 4/1989 Nowak ..... A63F 9/10 273/157 R
5,074,794 A * 12/1991 Von Hagen ..... G09B 1/06 434/193
5,176,521 A * 1/1993 McRae ..... G09B 1/10 434/200
5,190,287 A * 3/1993 Ishiyama ..... A63F 9/0666 273/156
5,575,658 A * 11/1996 Barnard ..... G09B 1/06 273/157 R
5,752,701 A * 5/1998 Kao ..... A63F 3/00574 273/153 R
6,105,790 A * 8/2000 Parks ..... A47B 63/00 211/42
6,626,678 B2 * 9/2003 Forbes ..... A63F 9/0666 273/153 R
7,530,571 B1 * 5/2009 Bell ..... A63F 3/00 273/236
8,992,229 B2 * 3/2015 Spital ..... G09B 1/02 434/259
9,403,084 B2 * 8/2016 Klemm ..... G09B 23/02
2005/0184459 A1 * 8/2005 Marantz ..... A63F 9/10 273/157 R
2005/0200076 A1 * 9/2005 Wu ..... A63F 9/10 273/157 R
2007/0085269 A1 * 4/2007 Martin ..... A63F 9/10 273/157 R
2007/0164513 A1 * 7/2007 Gelman ..... A63F 9/10 273/157 R
2007/0278740 A1 * 12/2007 Mao ..... A63F 9/10 273/157 R
2013/0320620 A1 * 12/2013 Shields ..... A63F 9/10 273/157 R
2018/0028887 A1 * 2/2018 Hofmann ..... A63F 9/0666
2020/0129849 A1 * 4/2020 Dragunsky ..... A63F 9/0612

OTHER PUBLICATIONS

"2016 Products", <https://www.pinterest.ch/Eduzoneltd/2016-products/>, retrieved on Aug. 18, 2021. (Year: 2016).*

* cited by examiner

DEEP CUTOUT SAFE PUZZLE

BACKGROUND

Certain puzzles for children and toddlers come with pegs which stick outward to enable a child to place a correspondingly shaped block over the peg. The puzzle may be such that the child has to find and use the correct block for a given peg. The puzzles may be configured to teach the child shapes, such as find the triangular-shaped block for the triangular shaped peg. Some puzzles have sets of pegs sticking outward, in which case the child has to find the block with the appropriate number of holes to fit over a given set of pegs. In any case, the pegs sticking outward can pose a danger to the child.

SUMMARY

A safe puzzle that is configured with deep cutouts inside a base block is implemented to provide a cavity inside which the pegs are shielded. The base block may have multiple cutouts and inside each one is a peg that serves as the puzzle for the child. For example, the cutouts can have a square peg, triangular peg, circular peg, and ovular peg that extend vertically from a floor of each cutout. A gap between the peg and the cutout's walls surrounds the pegs so that the child and a parent have sufficient space for their hand to manipulate the blocks, such as place the blocks over the pegs and remove the blocks from the pegs.

The safe puzzle may utilize shaped pegs inside each cutout or other learning mechanisms. For example, the safe puzzle may put sets of same-shaped pegs inside each cutout which work with blocks that have a corresponding number of holes. Lettered or numbered pegs may stick outward as well, in which a corresponding lettered or numbered block that somehow mates with the peg can be used.

The pegs may stick upward inside the cutouts but, in typical implementations, may not extend beyond base block's surface. The pegs may be the same height as the base block's surface or be below the base block's surface. By keeping the pegs at an equal or lower level than the block's surface, the pegs are shielded inside the base and cannot cause accidental injury to a child. This makes the safe puzzle age-appropriate, in terms of safety, for virtually any age.

While certain toddlers and babies may not be able to intellectually use the puzzle until a certain age, the safe puzzle is a safe purchase at virtually any age for a child, even when the baby is only a few days old. The parent does not need to worry about the child tripping and falling into the puzzle's pegs since they are shielded inside the base. Even older toddlers are prone to tripping and falling, in which case the safe puzzle disclosed herein can reduce worry for the parent that their child may slip and fall on a peg.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. It will be appreciated that the above-described subject matter may be implemented as a computer-controlled apparatus, a computer process, a computing system, or as an article of manufacture such as one or more computer-readable storage media. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
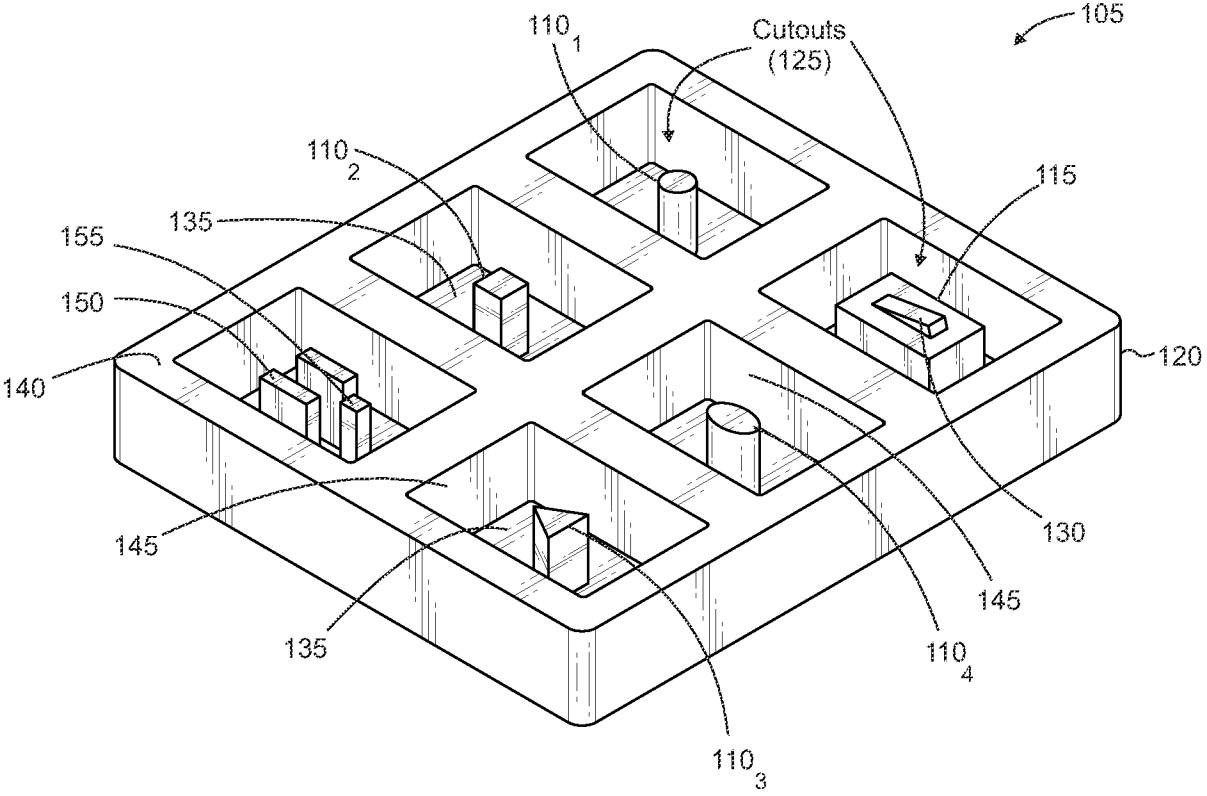
FIG. 1 shows an illustrative representation of a safe puzzle having pegs positioned inside cutouts of a base block.

FIG. 1 shows an illustrative representation in which a safe puzzle 105 is implemented to provide a safer play environment for toddlers and children. In typical implementations, the safe puzzle may be comprised of wood, but alternative materials can include plastic or other suitable polymer. The various components and configurations create a puzzle that challenges a child's intellect while reducing the possibility of injury. For example, the safe puzzle includes a base block 120 that has a top surface 140 and then a series of cutouts 125 that extend below the top surface. Each cutout includes a bottom surface 135 and a series of walls 145 that surround a peg 110 or other activity.

The pegs 110 can come in various shapes and sizes or can provide a different challenge. For example, multiple shapes 150, 155 can be placed in a cutout 125 to, for example, replicate a real-life object like a plug or outlet. In other examples, a switch 130 may be placed inside a cutout. The switch, or other activity, may be placed on a distinct block 115 that functions as a pedestal to raise the activity nearer to the base block's top surface 140. Some press-fit or other mechanisms may be placed under opposing ends of the switch, so that the switch moves responsive to user pressure on each respective end.

Figure 2:
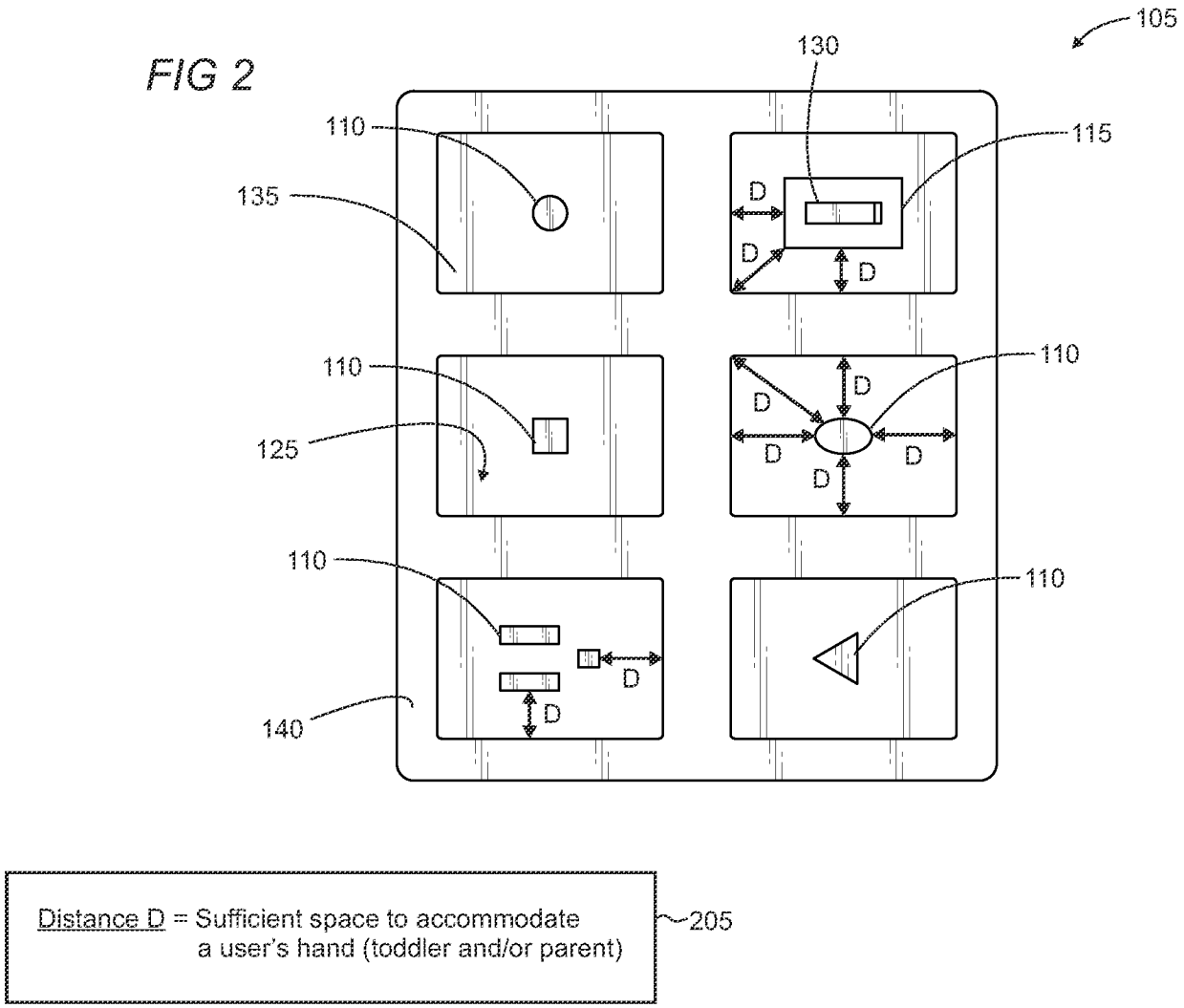
FIG. 2 shows an illustrative representation of the safe puzzle having certain distance configurations to provide sufficient space for a user's hands.

FIG. 2 shows an illustrative representation in which each cutout 125 is configured with sufficient space to accommodate a user's hands while playing with the safe puzzle 105. The distance D around each individual peg may be configured with sufficient distance to a surrounding wall 145 (FIG. 1) so one or more of the toddler or parent's hands can fit inside the cutouts while playing, as representatively shown by table 205. The distance D may be measured at multiple angles as insufficient space on one side may hinder play. Thus, for example, the distance D may be measured vertically, horizontally, diagonally, and from multiple different pieces inside a respective cutout. For example, the plug shapes 150, 155 and the pedestal block 115 may be measured differently since they occupy different levels of space. The outlet shapes illustrate that the distance may be measured from multiple different pegs inside a single cutout, as opposed to going by a single peg for some of the other shapes.

Figure 3:
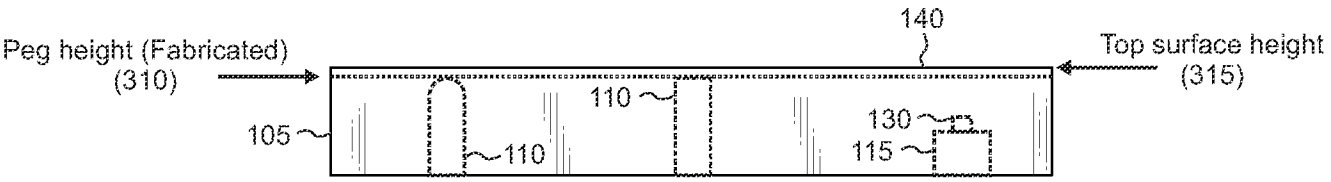
FIG. 3 shows an illustrative representation of the pegs having a distance below the top base block's top surface.
Figure 4:
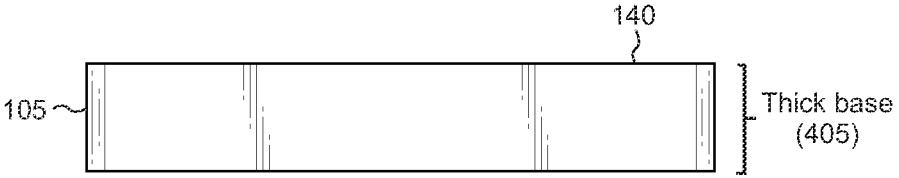
FIG. 4 shows an illustrative representation of the base block's thick base.

FIGS. 3 and 4 show illustrative representations in which the configurations of the base block 120 help provide the safe play environment associated with the safe puzzle 105. For example, the peg height 310 of the pegs 110 do not exceed the base's top surface 315. In typical implementations, the pegs may be below the top surface's height or even with the top surface's height.

If the pegs 110 extend above the top surface's height 315, then it may be a small amount to make sure that the pegs do not stick out too far and cause injury. By relying on the base block's deep cutouts 125, the pegs are largely shielded by the base block's top surface 140 and surrounding body, which can thereby prevent a child or toddler from accidentally falling onto the pegs and being injured. The safe puzzle 105 can provide various types of puzzles to challenge a child's ingenuity or knowledge, but do so in a safer environment.

Figure 5:
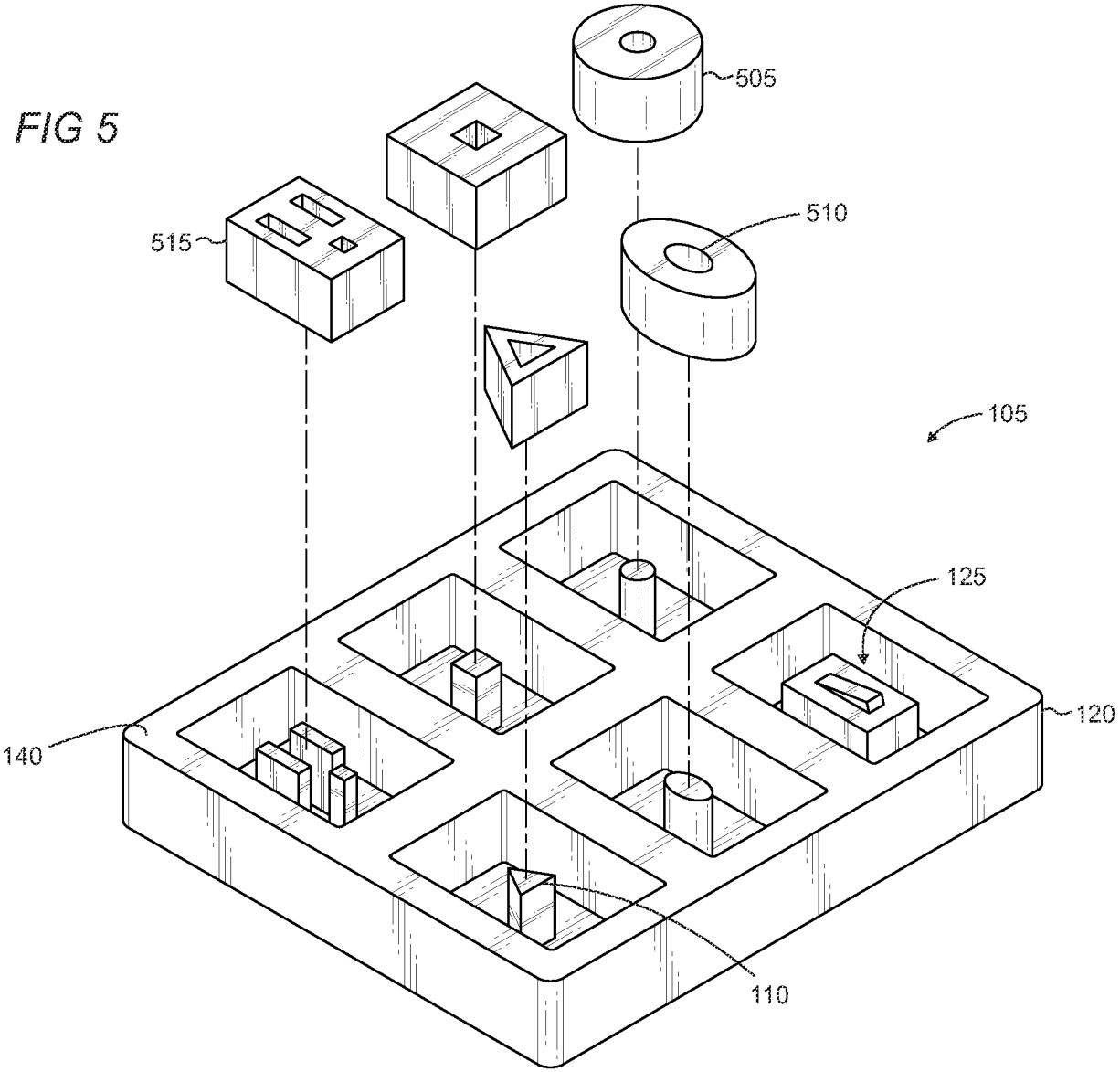
FIG. 5 shows an illustrative representation of blocks that correspond to the shapes of the various pegs.
Figure 6:
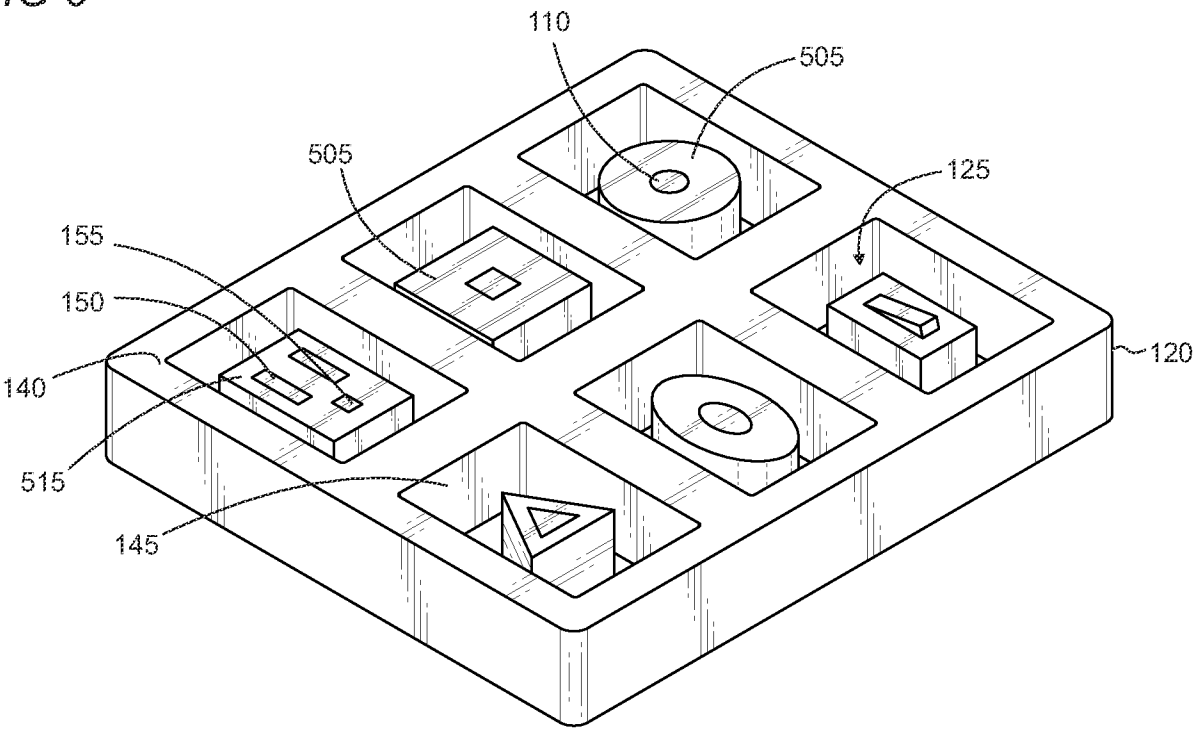
FIG. 6 shows an illustrative representation of the blocks engaging over the pegs and inside the cutouts.

FIGS. 5 and 6 show illustrative representations in which blocks 505 of varying shapes have holes 510 that fit over respective pegs 110 on the base block 120. A cylindrical, triangular, circular, and square block have holes that fit over like-pegs. For example, the cylindrical block has a cylindrical hole that fits over the cylindrical peg, and so on for the rest of the shapes. The block 515, which is meant to provide a real-life example of a power outlet, has multiple and distinct size holes to fit over the pegs 150 and 155. The blocks may fit entirely within the respective cavities 125, such as below or even with the top surface's height (FIG. 3), so that injury is further averted even when the blocks are positioned over (or stored on) the base block.

Figure 7:
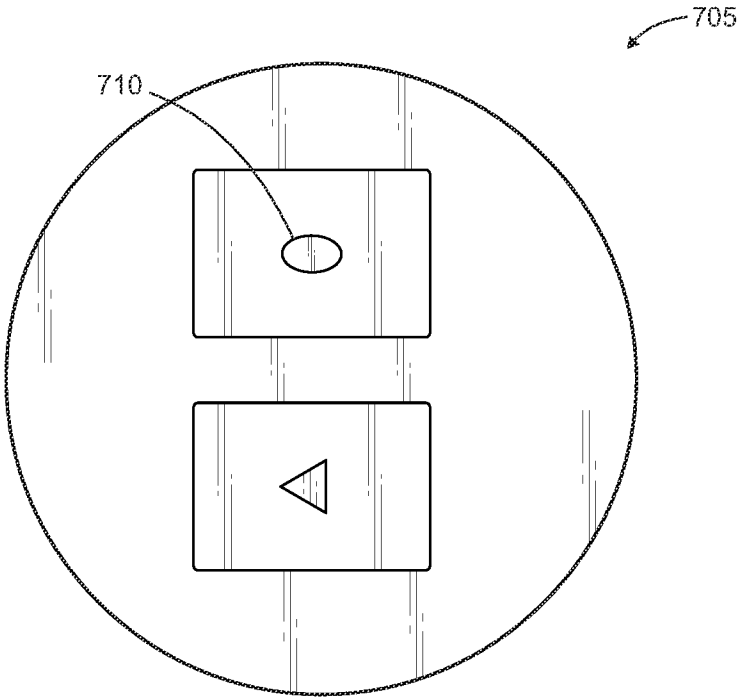
FIG. 7 shows an illustrative representation of a different shaped base block as an alternative embodiment.
Figure 8:
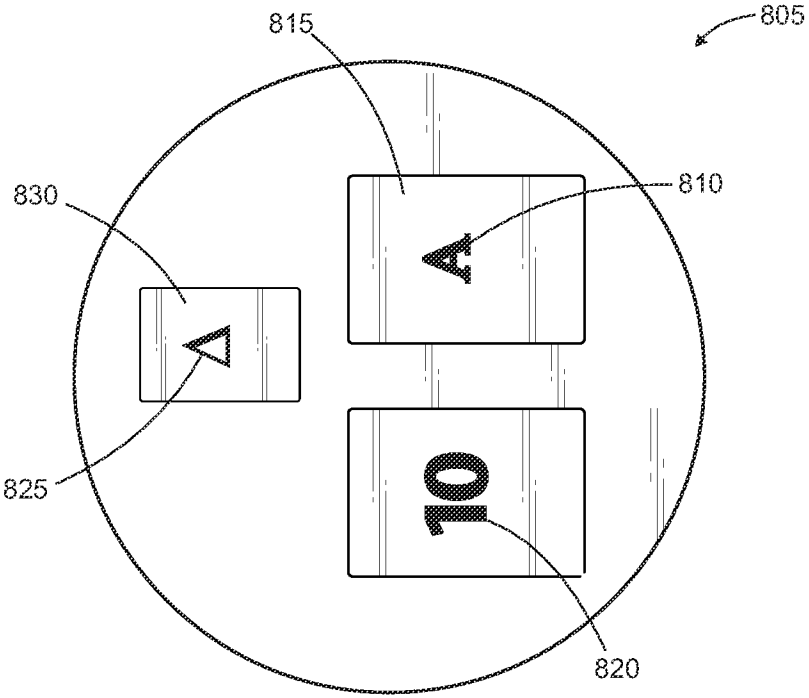
FIG. 8 shows an illustrative representation of different puzzles that can be used inside the cutouts of the base block.

FIGS. 7 and 8 show illustrative representations in which the safe puzzle can be implemented with different designs, shapes, and types of puzzles. For example, the safe puzzle 705 is configured with a circular shape to further provide a safe environment for a user. While only two pegs 710 are shown, additional pegs, cavities, and activities (similar to safe puzzle 105) can be implemented, and the example in FIG. 7 is to illustrate that the safe puzzle can come in a different shape. Other shapes can include an octagon, rhombus, triangle, square, trapezoid, oval, and other polygons or shapes. Corners can be rounded off in various embodiments to protect the child from any corners.

FIG. 8 shows another example in which the safe puzzle 805 has different sized cavities and learning activities. For example, the safe puzzle includes cavity 815 which is larger than the cavity 830. Furthermore, the pegs in these example are letters 810, numbers 820, or other mathematical symbols 825. In these embodiments, the letters, numbers, or symbols may not be pegs, but flat against a bottom surface of the cavities so that older puzzles can be given a new look. Alternatively, a mix of relatively flatter symbols, letters, numbers, or shapes can be used in combination with the pegs.

In some embodiments, the base block 120 may be configured with a one or more cavities 120 and then one or more generic-type cavities that can fit a flat puzzle piece. This way, a single base block can be used for playing with pegs and blocks and then letters, numbers, symbols, or flatter shapes.

In some embodiments, the base block 120 can be configured with a drawer that can pull out from one of its sides. For example, relying on the larger height of the base block, a draw can be put into the block to accommodate, for example, puzzle pieces. The base block can be extended beyond the cavities so that a draw of sufficient size can be created. Alternatively, when smaller cutouts are used for flatter puzzle pieces, numbers, letters, or symbols (whether combined with the cavities and pegs or not), the draw can be positioned below the smaller cutouts since it's space would otherwise not be used.

Implemented are various examples of the safe puzzle. One example includes a safe puzzle, comprising: a base block having a top surface and a bottom surface; a cutout in the top surface, the cutout having a bottom and surrounding walls; a peg extending from the bottom of the cutout and in a direction toward the top surface of the base block; and a gap surrounding the peg, wherein the gap extends between the peg and the surrounding walls of the cutout.

In another example, the peg has a height that is equal with the top surface's plane. As another example, the peg has a height that is below the top surface's plane. As another example, the peg is formed as a geometric shape, letter, or number. In another example, the geometric shape is a circle, triangle, square, oval, rectangle, rhombus, trapezoid, or circle. As another example, the safe puzzle further includes multiple cutouts with multiple pegs, in which each peg is a different geometric shape, letter, or number. In that example, the cutout and gap are sized to accommodate a user's hand and fingers. In another example, the safe puzzle further includes a block, wherein the block includes a hole that that is shaped to fit a corresponding peg. As another example, when the block is positioned over the corresponding peg, the block's height is even to or below the top surface's plane, such that a heights of the peg and the block are each either even with or below the height of the top surface's plane. In another example, the safe puzzle further includes a cutout having a mechanical mechanism that moves responsive to user manipulation. As another example, the peg is part of a set of pegs within the cutout, and a block includes multiple holes that are positioned and oriented to fit around the set of pegs. As another example, the block is comprised of wood. As another example, the peg is formed as a geometric shape, letter, or number.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A safe puzzle, comprising:

a base block having a top surface;

multiple cutouts in the top surface of the base block, each cutout having a bottom surface and surrounding walls, such that each cutout is independent of other cutouts on the base block;

pegs extending vertically from the bottom surfaces of their respective cutouts and in a direction toward the top surface of the base block, the bottom surfaces being positioned below the pegs, wherein the pegs have a height that is substantially equal to or below a plane of the top surface, wherein each cutout has a gap surrounding its peg, wherein the gap extends between the peg and the surrounding walls of the respective cutout, such that each cutout includes a peg, surrounding walls, and a gap; and multiple blocks, each block having a hole that is shaped and sized to correspond to one of the pegs within the cutouts, wherein a height of each block corresponds to a height of the pegs, wherein, when the blocks are inserted over the respective and corresponding peg, a portion of the gaps are still present such that the surrounding walls and bottom surfaces are exposed.

2. The safe puzzle of claim 1, wherein the pegs are formed as a geometric shape, letter, or number.

3. The safe puzzle of claim 2, wherein the geometric shape is a triangle, square, oval, rectangle, rhombus, trapezoid, or circle.

4. The safe puzzle of claim 2, wherein each peg is a different geometric shape, letter, or number.

5. The safe puzzle of claim 1, wherein at least one cutout has a set of multiple pegs, and the respective block for the at least one cutout includes multiple holes that are positioned and oriented to fit around the set of multiple pegs.

6. The safe puzzle of claim 1, wherein the block is comprised of wood.

* * * * *